United States Patent [19]

Trame et al.

[11] Patent Number: 5,003,717

[45] Date of Patent: Apr. 2, 1991

[54] CHANGEABLE INFORMATION SCROLL SIGN

[75] Inventors: Charles E. Trame, Mequon; Robert A. Karsten, Fox Point; Michael W. Hobach, Oak Creek, all of Wis.

[73] Assignee: Everbrite, Inc., Greenfield, Wis.

[21] Appl. No.: 408,993

[22] Filed: Sep. 18, 1989

[51] Int. Cl.[5] ..... G09F 11/18

[52] U.S. Cl. ..... 40/518; 40/520; 40/471

[58] Field of Search ..... 40/514–524, 40/414, 423, 429, 430, 431, 347, 470–473, 385–387, 617, 619; 250/231.18; 353/26 A

[56] References Cited

U.S. PATENT DOCUMENTS

| | | | |
|---|---|---|---|
| 2,019,113 | 10/1935 | Boyce | 40/619 |
| 3,007,100 | 10/1961 | Bettcher | 40/471 |
| 3,255,541 | 6/1966 | Bettcher | 40/471 |
| 3,798,808 | 3/1974 | Van Wagenen et al. | 40/473 |
| 3,824,584 | 7/1974 | Fowler | 250/231.18 |
| 3,963,336 | 6/1976 | Haning et al. | 353/26 A |
| 3,999,846 | 12/1976 | Sone et al. | 353/26 A |
| 4,000,573 | 1/1977 | Cohen | 40/620 |
| 4,707,938 | 11/1987 | Carssow | 40/471 |
| 4,741,118 | 5/1988 | Aiken et al. | 40/471 |

FOREIGN PATENT DOCUMENTS

| | | | |
|---|---|---|---|
| 1188369 | 3/1959 | France | 40/473 |
| 1428104 | 3/1976 | United Kingdom | 40/471 |

*Primary Examiner*—Kenneth J. Dorner
*Assistant Examiner*—James M. Gardner
*Attorney, Agent, or Firm*—Fuller, Ryan & Hohenfeldt

[57] ABSTRACT

A sign composed of modules mounted adjacent each other. Each module having laterally spaced apart side wall members and a pair of longitudinally spaced apart parallel rollers mounted between the side wall members for rotating. Opposite end portions of a web containing a series of indicia are wound on the rollers, respectively, such that a selected indicia can be positioned in viewing position by winding web on one roller while unwinding it on the other roller. There are motor means mounted inside of each of the rollers for rotating the rollers to translate the web. In the depicted embodiment, an electric motor means is mounted inside of one of the rollers and a constant force spring motor means is mounted on the inside of the other of the rollers. The motors oppose each other in such a way that the web is maintained taut between them.

8 Claims, 9 Drawing Sheets

CHANGEABLE INFORMATION SCROLL SIGN

BACKGROUND OF THE INVENTION

The invention disclosed herein relates to a sign of the type in which indicia such as numerals indicating a price may be changed by scrolling webs in individual modules which are arranged adjacent each other. Ambient light may be relied upon for allowing reading of the indicia but usually the webs are back lighted.

It is often necessary to change pricing or other information that is readable from a sign. The sign disclosed herein is especially desirable for displaying the price of gasoline and, possibly, the name of the retailer such that this information can be seen from a great distance by automobile drivers. The sign is usually mounted at a substantial height near to the highway but remote from the station at which the gasoline is dispensed.

Signs in which webs containing indicia are scrolled to change the information which the sign is displaying are known. One such sign is described in U.S. Pat. No. 4,741,118. In this patent, the individual webs containing the indicia have their opposite ends wound on rolls which can be driven rotationally so that one roll pays out web and the other roll takes up web to locate a particular indicia in the display window of the sign. A group of webs are placed adjacent each other and their take-up rolls are journaled for turning on a common shaft. The shafts on which the take-up and pay-out roll for each web are journaled for rotation are driven by a single motor which is energized to rotate in one direction or the other when one or more webs is to be translated to change the indicia which are being displayed. A clutch is affiliated with each take-up roll. The electrical controls provide for starting the motor and engaging a selected one of the clutches when an indicia is to be changed. When that indicia reaches the display position in the viewing window of the sign, the clutch disengages. Because the drive motor and drive shafts are necessarily displaced from the web rollers in the design, the housing for the sign must be made substantially larger to accommodate these parts.

Another changeable scrolling sign is described in U.S. Pat. No. 3,255,541. In this patent the rolls on which the opposite ends of the web are wound are mechanically coupled by means of sprockets and a chain so they rotate together when one of the sprockets or gears is driven by a single motor. In this patent, the drive shafts for the rolls are coupled to the rolls through the agency of preloaded coil or torsion springs which are preloaded in a direction such that when driving power is discontinued the stored energy in the springs tends to rotate the rolls in a direction which imparts tension to the web extending between the rolls. In this patent and the patent discussed above, the drive motors for the rollers must be placed where they will not cast a shadow on the webs. As a result, the housing of the sign must be made larger so that the power can be displaced from the webs.

SUMMARY OF THE INVENTION

In accordance with the invention, a sign for displaying selected numerals, letters and other characters comprised of individual indicia displaying modules which are arranged adjacent each other. Each module is comprised of two rollers which are mounted for rotation on a frame with their axes parallel to each other. The opposite ends of a web are wrapped around the respective rollers such that when the rollers are rotated in one direction the web is wound on one of the rollers and unwound from the other of the rollers. The web has a series of indicia such as numbers or letters impressed on it such that different indicia can be positioned in a display window by causing the rollers to rotate using controls at a remote station. The motor for rotating the roller in each of the modules to translate the web is located inside of a roller. This unique feature contributes to the compactness of the module, avoids any possibility of the motor casting a shadow on a back lighted web and has other advantages which will become apparent later.

In one embodiment, tension is maintained in the web at all times by a prestressed constant force spiral spring. One such spring is known by the trademark Spirator. Constant force springs are notable for providing substantially constant torque throughout their operating range regardless of the direction in which they would be inclined to wind or unwind in response to being turned in one direction or another. In the embodiment of the invention wherein an electric motor is used in only one roll and a constant force spring is used in the other cooperating roll, the spring is stressed additionally in torsion when the electric motor is driven in a direction to unwind the web from the roller which contains the spring. The torsion force developed in the spring under this condition opposes the motor and tends to keep the web taut and unwrinkled. When the motor is operated in the opposite direction it causes the web to unwind from the roller which contains the electric motor and winds onto the roller which contains the spring in which case the stored energy in the spring pulls the web from the electric motor containing roller. When the electric motor is deenergized, the stress that is still stored in the spring motor keeps the web in tension or taut and unwrinkled.

In an embodiment which is not illustrated herein, an electric motor is installed in each of the parallel web handling rollers in a module. Their rotational directions are opposite such that the web can be unwound from either of the rollers and simultaneously wound on the other of the rollers.

How the foregoing features and other features of the invention are implemented will become apparent in the more detailed description of an illustrative embodiment of the invention which will now be set forth in reference to the drawings.

DESCRIPTION OF THE DRAWINGS

FIGS. 10 10A and 10B comprise a logical flow diagram which pertains to the manner in which the modules are operated.

DESCRIPTION OF A PREFERRED EMBODIMENT

Figure 1:
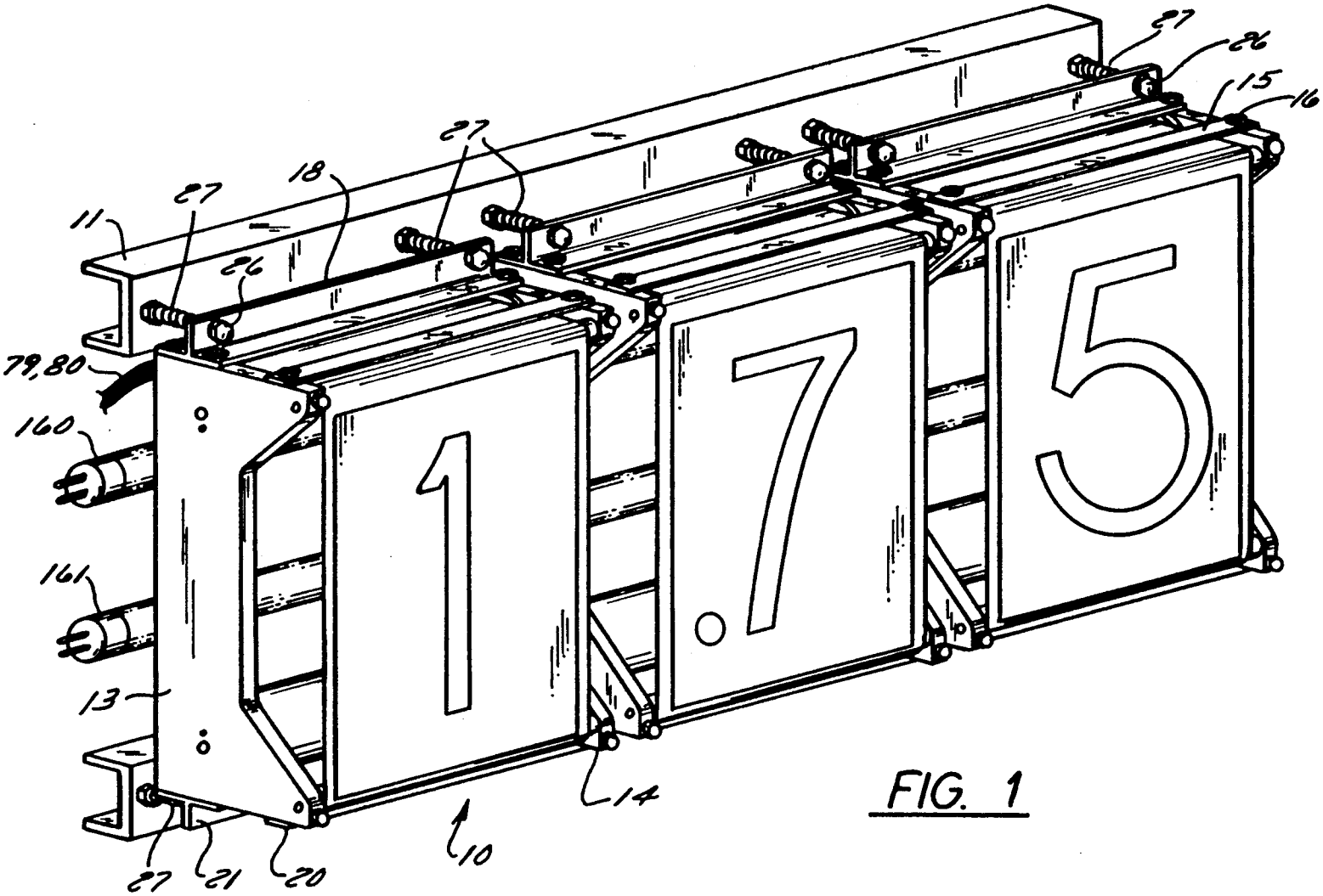
FIG. 1 is a perspective view of three of the new type of changeable indicia web scrolling modules which can be used to make up a sign.

FIG. 1 shows three sign modules which are generally designated by the numeral 10 and are mounted adjacent each other on structural frame members in the form of channel members 11. Each module contains a translatable web 12 composed of a polyester such as Mylar for example. The webs may have indicia silk screened onto them such as a series of numbers from 0 to 9 so that in conjunction with each other they can display a price such as the price of gasoline. If used to display the price of gasoline there would usually be an additional module arranged to the right of the right-most module in FIG. 1 for displaying the decimal part of a cent such as 0.9 which is done traditionally by gasoline retailers. One of the webs such as the one exhibiting 7 in FIG. 1 can have a decimal point associated with each indicia. The modules depicted in FIG. 1 would ordinarily be contained within a housing, not shown, in which there is a transparent window overlaying the individual webs and the webs would be masked in such a way that the mechanism of the sign would not be visible to an observer.

Figure 2:
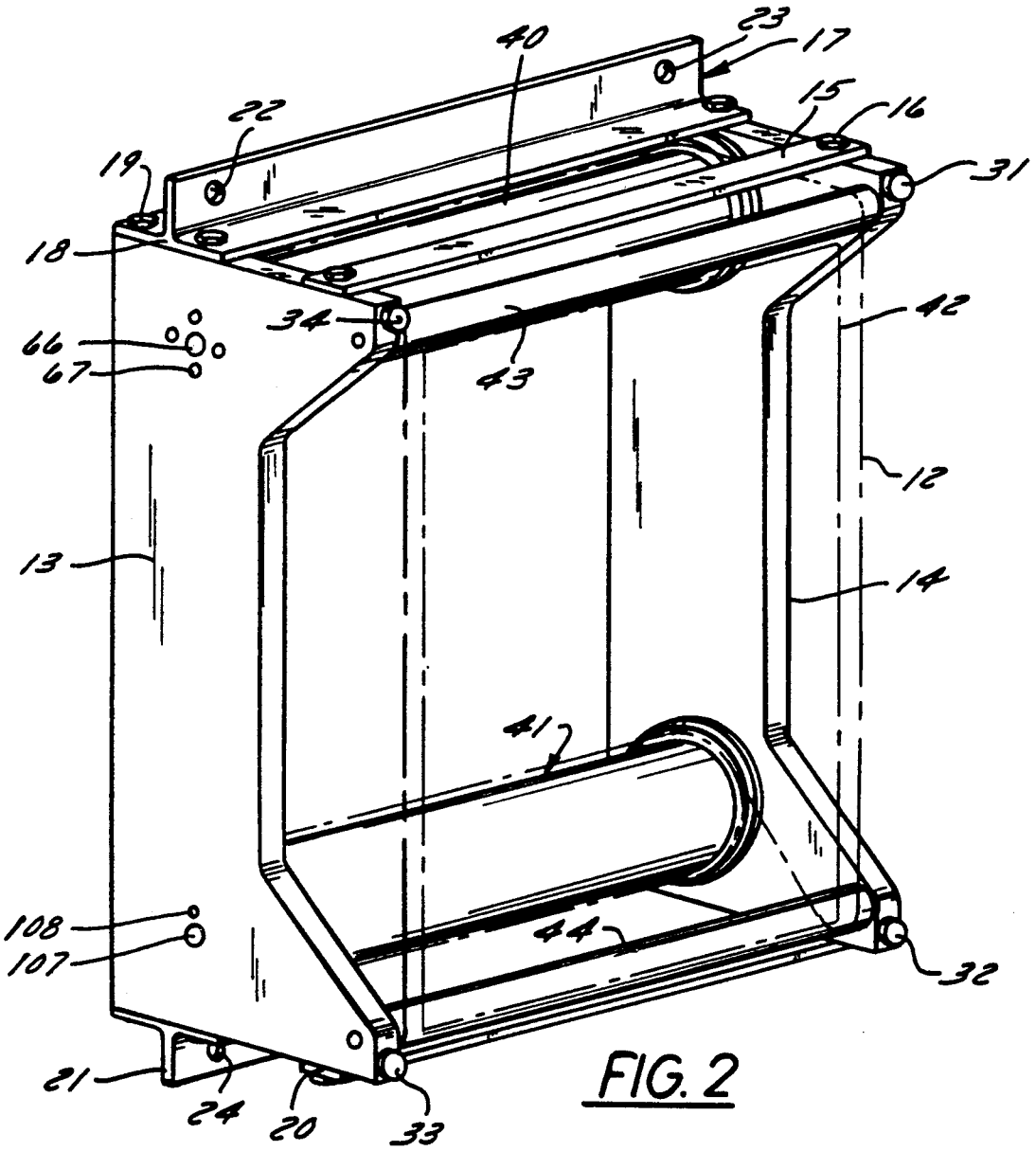
FIG. 2 is a perspective view of one of the modules with the indicia bearing web omitted to permit visualizing the interior of the module.

The basic construction of a module is shown in FIG. 2 with the indicia bearing web 12 outlined in phantom to allow better visualization of the construction. A module frame comprises side wall members 13 and 14 which, as a matter of choice, may be composed of a transparent strong industrial plastic or aluminum, for example. The side members 12 and 13 are tied together at the top by means of a bar 15 which is secured to the side members by machine bolts such as the one marked 16. The members are also spanned by and tied together on top by a T-shaped member 17 whose flange 18 is bolted to the top edges of the side members by machine bolts such as the one marked 19. The side members 12 and 13 are also tied together at their bottoms by a bar 20 and a T-shaped member 21 which are bolted to the bottom edges of the side members similarly to the way in which the bar 15 and T-shaped member 17 are bolted to the laterally spaced apart side frame members. The upper T-shaped member 17 has a pair of holes 22 and 23 and the bottom T-shaped member 21 has a pair of holes, one of which is marked 24 and is visible in FIG. 2 and the other of which is marked 25 and is visible in FIG. 6. The holes are used for mounting the modules on a sign frame member such as channel members 11 which are used for illustrative purposes.

Figure 3:
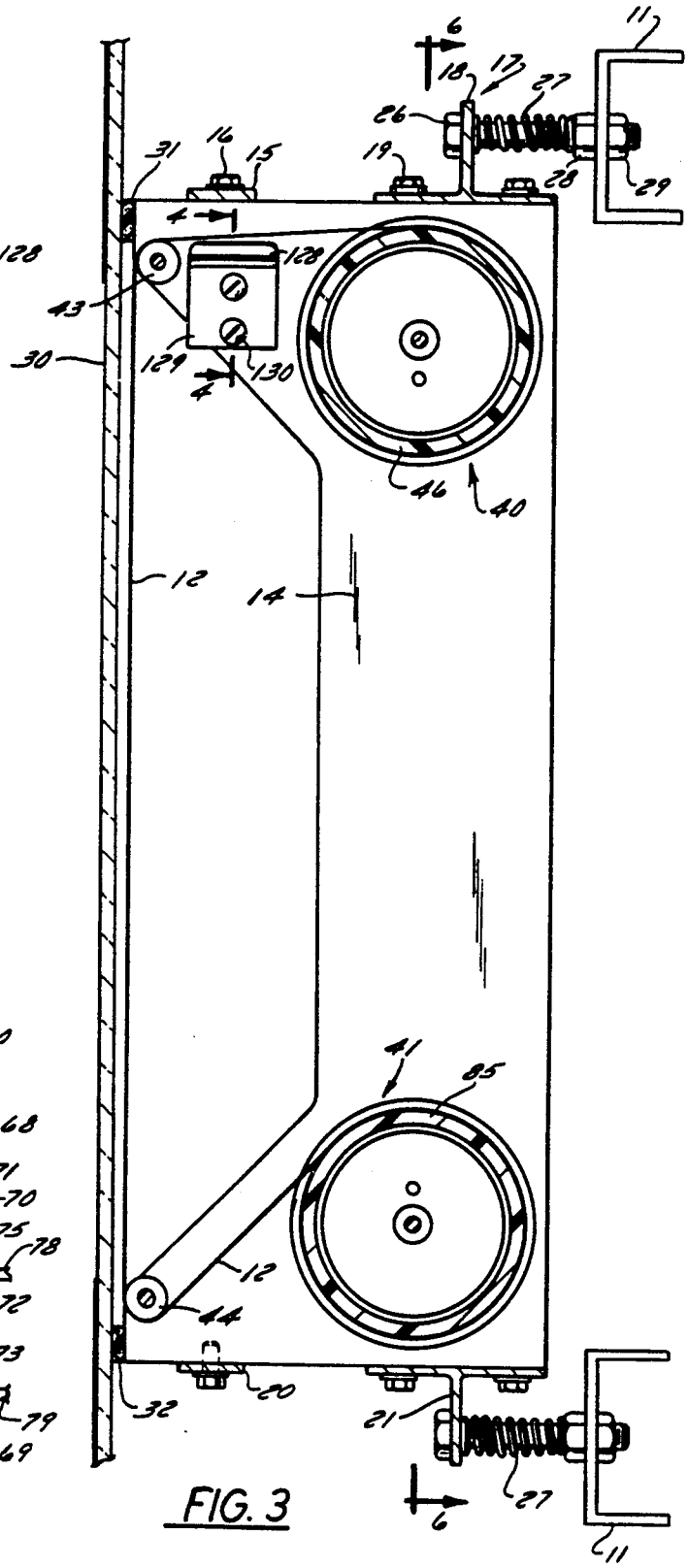
FIG. 3 is a vertical section of a module which illustrates how it is mounted independently of other modules and is presented toward a viewing window.

As shown in FIGS. 1 and 3, machine bolts such as the one marked 26 pass through the holes in the T-shaped members and through an appropriate hole, not shown, in the support channel members 11. There is a spring 27 on each of the bolts. As can be seen best in FIG. 3, the threaded end of a bolt 26 has an adjustment nut 28 screwed on it so that it bears on one side of the channel member 11 and a lock nut 29 is also screwed on the threaded end of the bolt to lock the bolt tightly onto support channel members 11. The inside nut 28 is turned on the bolt by a sufficient amount to preload the spring 27. The preloaded springs on each of the bolts supporting a module tend to press the module toward the transparent window material 30 behind which the indicia bearing web 12 is arranged. At the edges of the side members there are resilient disks 31–34 which may be composed of a material such as foam rubber. These disks provide for allowing the modules to interface resiliently with the window panel 30 under the compressive force developed by the four springs 27 on the mounting bolts 26. As indicated, the amount of force which presses the module frames against the window can be adjusted by means of nuts 28. If nut 28 is turned farther onto the thread of bolts 26, greater stress is induced in springs 27 so the force for pressing the modules against the window becomes greater. If the nut 28 is backed off of the thread, the opposite happens, that is, less stress is developed in the spring 27 and the frame of the module is pressed against the window with less force.

FIG. 2 shows how the rollers 40 and 41 for the web span laterally across the module from side member 13 to side member 14 in which the rollers are journaled for rotation. The edge of the web 12 which extends between rollers is indicated with a phantom line in FIG. 2. The window is masked, not shown, in such a way that the margin of the web is covered and the boundaries of the area that can be viewed are depicted in FIG. 2 in phantom lines marked 42. The web also runs over idler rollers 43 and 44 which assure that the web is held as close as possible to the window and parallel to the window.

Figure 6:
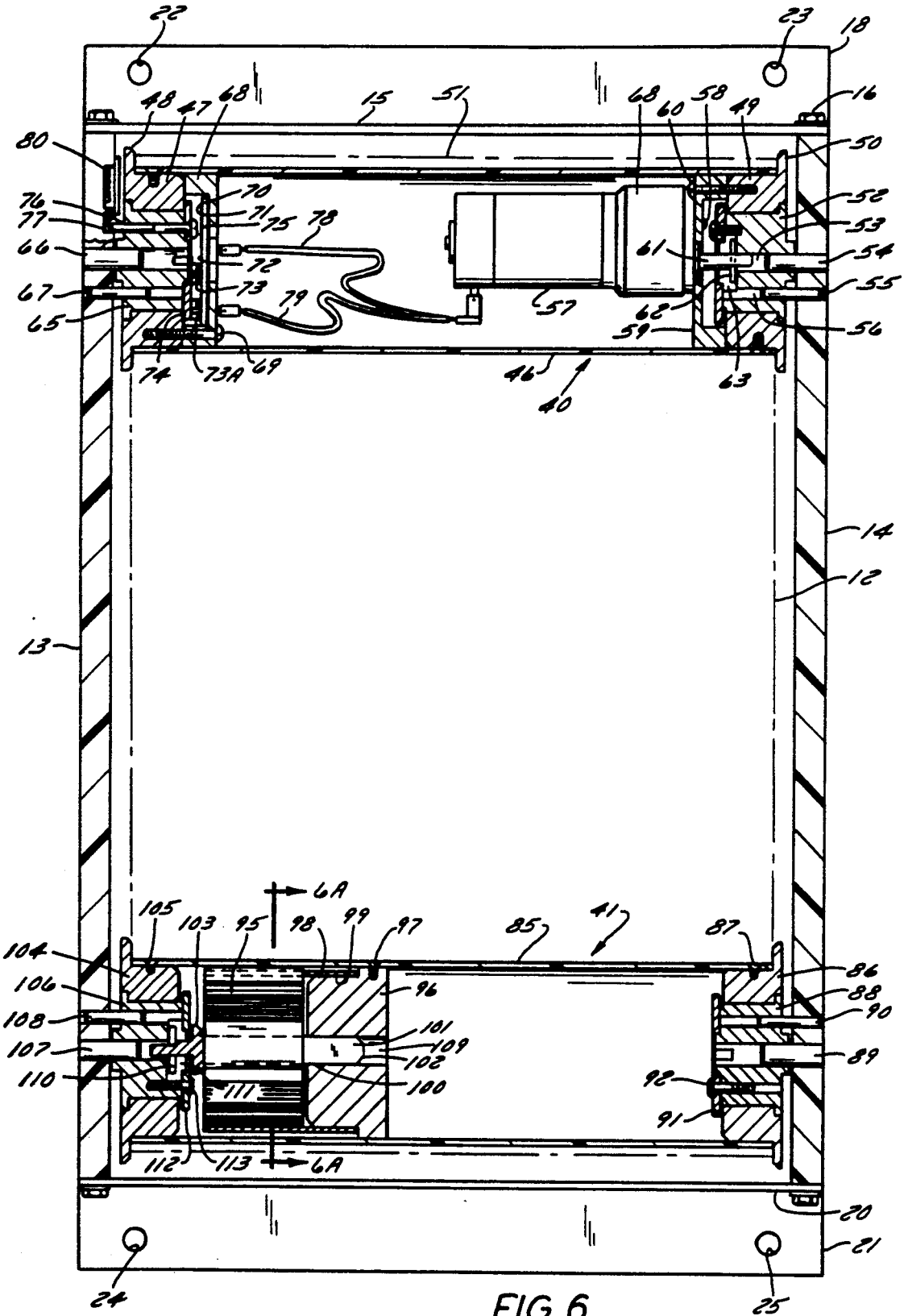
FIG. 6 is a vertical section through a sign module showing the interior of the rollers from which the web is wound and unwound.

Refer now to FIG. 6 for a discussion of the interior construction of rollers 40 and 41. Roller 40 comprises a tube or cylinder 46 which can be made of plastic or metal. An end cap is secured in the left end of roller cylinder 46 as viewed in FIG. 6. The end cap has a flange 48 which contributes to preventing the web 12 from being wound askew on the rollers. There is a similar end cap 49 at the right end of the roller as viewed in FIG. 6 and it has a flange 50. The accumulated layers of web wound on roller cylinder 46 are indicated with a phantom line and are marked 51. There is a fixedly mounted hub 52 inserted centrally in typical end cap 49 at the right end of the roller. The hub has a bore 53. A cylindrical rod 54 extends into bore 53 to support the hub. Rod 54 makes a tight fit where it passes through a hole in the side wall or frame member 14 of the sign module. There are also a plurality of dowel pins 55 which are circumferentially placed concentric to rod 54. These pins are anchored in side wall member 14 and extend into axial holes 56 in the hub. Thus, the pins prevent the hub from rotating and provide for the end cap member 49, to which the roller is fastened, rotating on hub 52. The end cap and hub are preferably made of materials which will result in low friction being developed between them. For example, a low friction material such as commercially available Nylatron GSM Nylon is suitable.

A reversible DC motor 57 is mounted by means of a circular array of screws, such as the one marked 58, to a dish shaped mounting plate 59. The mounting plate is secured to end cap 49 by means of a circular array of screws such as the one marked 60. The shaft 61 of motor 57 has a pin 62 extending radially through it. The pin extends into a slot 63 in hub 52 which is fixed against rotation. Consequently when reversible DC motor 57 is energized such that the shaft tries to turn, pin 62 reacts against the side of the slot in the stationary hub so that, instead of the shaft revolving relative to the hub, the whole motor rotates about the axis of shaft 61. Since motor 57 is fastened to end cap 49 with which the cylinder 46 of the roller is fastened, the whole roller 40 rotates as does the body of the motor when the motor is energized. Since the motor is reversible, the web or tape bearing the indicia can be made to wind on roller 40 or unwind from this roller by energizing the motor so it rotates in one direction or the other.

Figure 5:
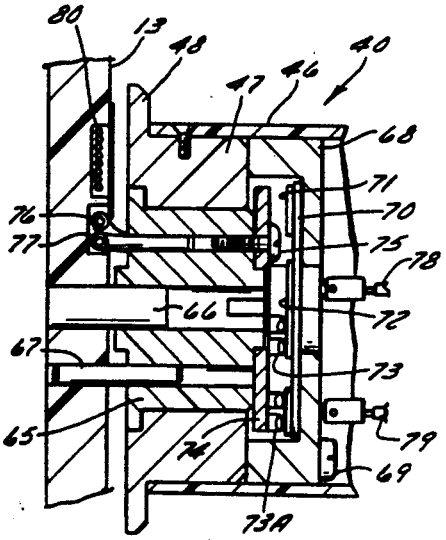
FIG. 5 is a section similar to the section exhibited in FIG. 6 but is enlarged to facilitate visualizing the details of the manner in which the electrical connections are made and the manner in which a roller is journaled at one end as is otherwise exhibited in demagnified form in FIG. 6.

The left end of the roller 40 in FIG. 6 is constructed somewhat similarly to the driving end just explained. A magnified view of the left end is presented in FIG. 5. The left end of the roller includes a hub 65 which is supported on a rod 66 and secured against rotation by a plurality of circumferentially spaced apart pins such as the one marked 67. The hub fits into a flanged end cap 47 which is journaled on the hub for rotation. A dish shaped mounting plate 68 is secured to end cap 47 for rotating with it by means of a plurality of circumferentially spaced apart screws such as the one marked 69. The space inside of the dish shaped mounting plate contains a disk 70 composed of insulating material. The disk has a thin circular metallic conducting slip ring 71 and a centrally located slip ring 72 bonded to it. There are electrical contacts or brushes 73 and 73A which are mounted to an insulating plate 74 which is secured to hub 65 by means of a plurality of circumferentially spaced apart screws such as the one marked 75. The brushes connect to incoming motor supply lines 76 and 77. Thus, there is a circuit from the motor supply lines through the brushes and slip rings to the motor leads 78 and 79. A multiple conductor flat cable 80 is clamped to side wall member 13 of the module frame near the left end of roller 40. This cable is used for reading out indicia position code markers as will be explained in more detail later.

The lower roller 41 in the FIG. 6 module comprises a cylindrical tube 85 which has a flanged end cap 86 fastened in its right end by means of flush screws 87. End cap 86 is journaled for rotation on a hub 88 which is supported on a rod 89 that is anchored in side wall member 89. A plurality of circumferentially spaced pins 90 secure the hub 88 against rotation. A retainer ring 91 is secured to the hub by means of screws 92. The retainer ring assures that the hub cannot slip axially from the end cap.

Referring to FIG. 6, the left end of the lower roller 41 contains a spring motor means comprising a constant force spiral spring 95. There is a retainer cylinder 96 secured inside of roller cylinder 85 by means of flush screws 97. A thin cylindrical sleeve 98 makes a tight fit with the shoulder of the retainer. Both the retainer and sleeve are preferably plastic and are preferably molded as a single piece. The sleeve is slotted and the outside end of spiral constant force spring 95 is engaged in the slot. The inner end 100 of the spiral spring fits into an axially extending slot 101 in an arbor 102. The arbor has a shoulder 103 which confines the edges of the spring convolutions between it and retainer 96. There is an end cap 104 secured in the end of roller cylinder 85 by means of screws 105. The end cap is journaled for rotation on hub 106. The hub is supported on a short rod 107 and is secured against rotation by means of a plurality of pins 108. The arbor 102 extends into a bore 109 in retainer 96 for support at its outboard end. The arbor is prevented from rotating by means of a pin 110 which extends through it and resides in a narrow slot 111 in stationary hub 104. Hub 106 is captured in end cap 104 by means of a ring 112 which is fastened to the hub by means of a plurality of screws such as the one marked 113.

Constant force springs are preferably obtained from one of the manufacturers who specializes in making them. The customer indicates to the manufacturer the dimension limitations, spring power, torque and revolutions through which the spring must drive a roller, for instance, and the manufacturer custom makes the spring. Making a constant force spring, such as spring 95, generally involves winding a strip of flat metal spring stock into a spiral coil and then, in a sense, unwinding it and rewinding it in the opposite direction after which the spring is fitted into a ring which facilitates slipping it into a retainer or drive sleeve such as the sleeve 98 which is in roller 41.

Figure 6A:
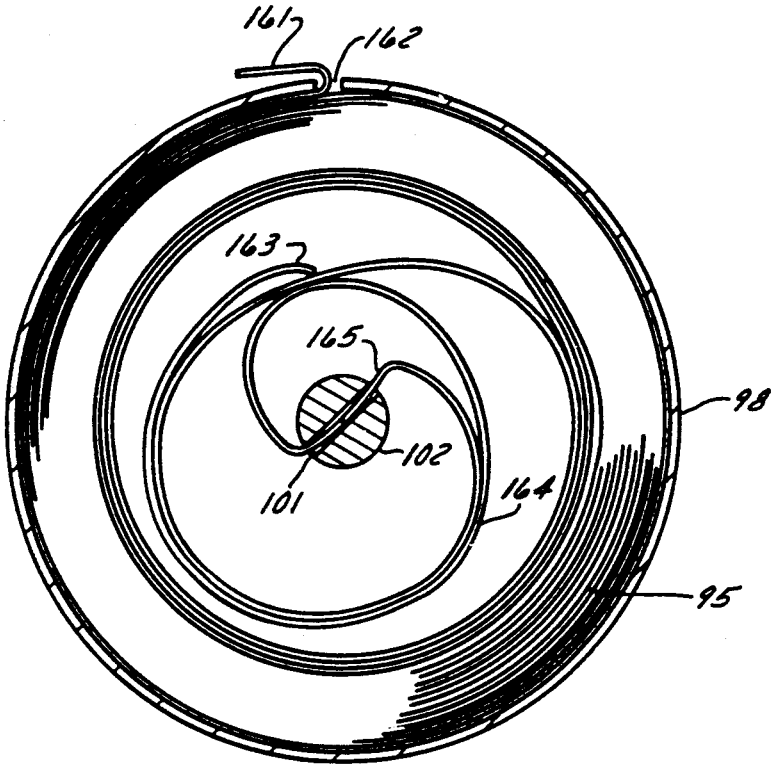
FIG. 6A is a sectional view taken on a line corresponding to 6A—6A in FIG. 6.
Figure 6B:
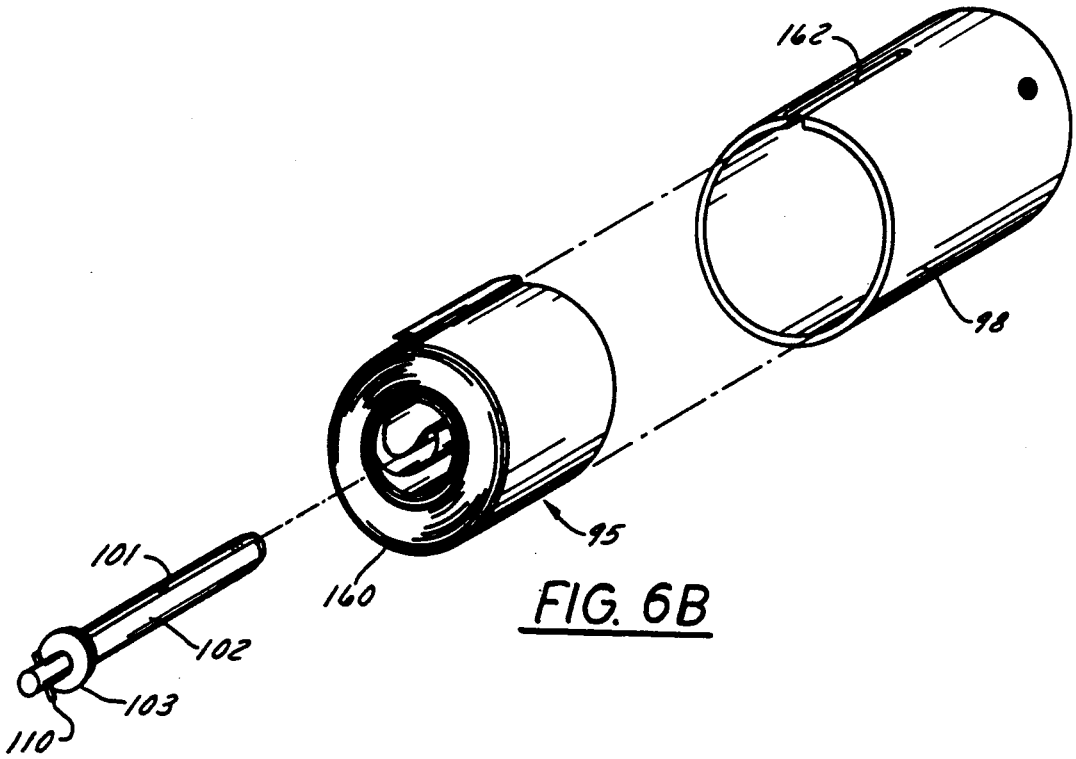
FIG. 6B is an exploded view consisting of an arbor, a constant force spring and a sleeve for containing the spring, these parts being derived from FIG. 5.

FIGS. 6A and 6B depict the arbor member 102, constant force spring 95 and sleeve 98, constituting the roller 41 drive, and web 12 tensioning device isolated from FIG. 6. The outside turn 160 of the constant force spring 95 terminates in a hooked end which resides in a slot 162 in sleeve 98 to attach that end to the sleeve. The inside end 163 of the spring terminates in two rather tightly wound turns 164 which are significant for achieving the constant force characteristic. At the onset of the two turns 163 the spring strip has a substantially straight section 165 which fits into slot 162 of the fixedly positioned on nonrotatable arbor member 102.

Upper roller 40 which contains the motor 57 can be characterized as the drive roller. Roller 41 which contains the constant force spring 95 may be characterized as the take-up roller. As one may see by referring to FIG. 3, rollers 40 and 41 will rotate in directions opposite of each other at any time the electric motor 57 is energized such that its shaft 61, which is anchored, allows the motor to rotate bodily for driving the roller cylinder 46, to which it is attached rotationally. Spring 95 is preloaded and maintains a constant force regardless of the direction in which the take up roller 41 is caused to rotate under the influence of drive roller 40 pulling on the web to make it move in one direction or under the influence of spring 95 itself which has a tendency to pull the web in the opposite direction. One end 68 of the electric motor 57 contains speed reduction gears. Thus, when the electric motor is deenergized, the spring 95 will act as a reversely operating motor to create substantial tension in the web 12 but will not create enough force to overhaul the electric motor.

When the electric motor is run in the opposite direction such as to cause the web to move vertically downwardly in FIG. 6 the electric motor simply causes the web to be paid out from upper roller 40 so that constant force spring 95 can act like a motor operating reversely to torque lower roller 41 and cause it to take up the web that is paid out from the drive roller 40. When the drive motor 57 is deenergized at the time the proper indicia is displayed between the two rollers, the constant force spring 95 continues to exert a rotational force on roller 41 such that the web is maintained under substantial tension. As indicated, the speed reduction gearing in motor housing portion 68 prevents the constant force spring 95 from overhauling or causing the electric motor body to rotate when it is deenergized.

Figure 4:
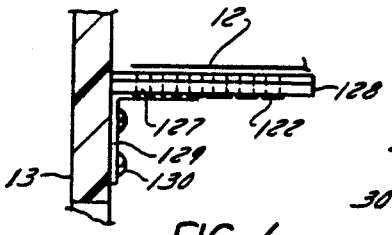
FIG. 4 is a vertical section of a positioning code sensing device taken on a line corresponding to 4—4 in FIG. 3.
Figure 7:
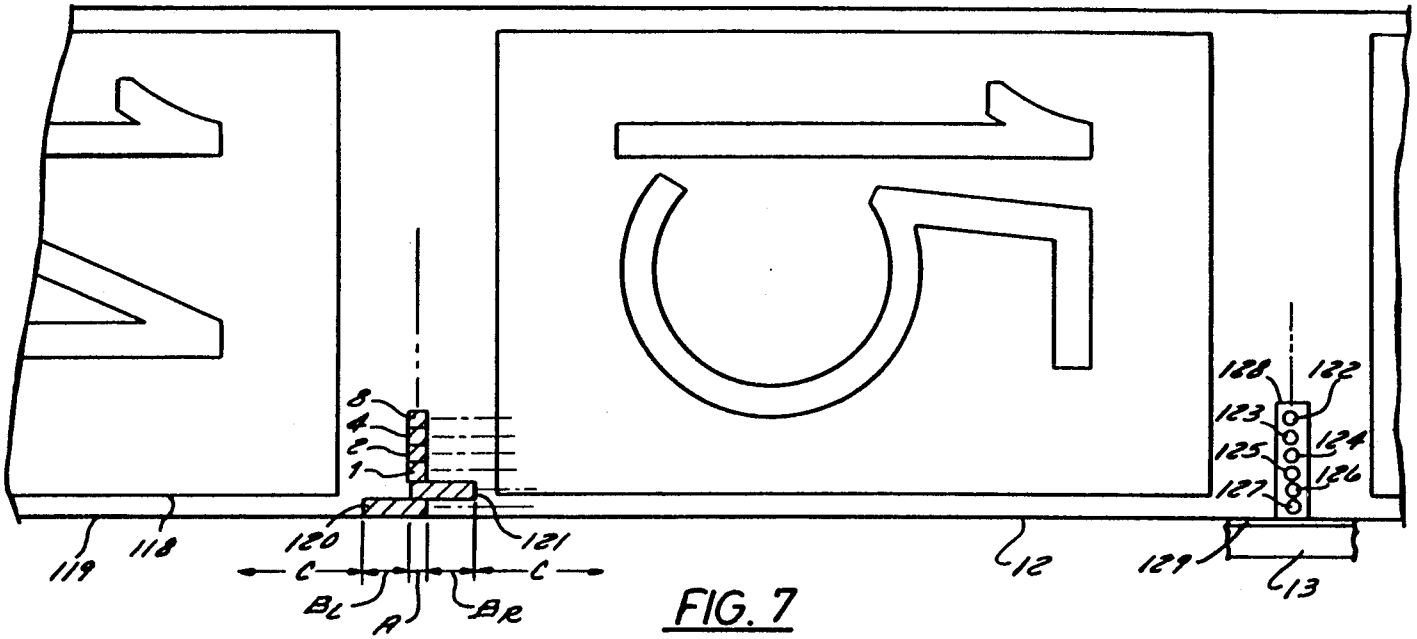
FIG. 7 is a diagram for facilitating explanation of the manner in which the web is accelerated, decelerated and stopped to present a selected indicia in viewing position.

The manner in which the individual indicia in each module are positioned in the viewing window will now be discussed. Attention is invited first to FIG. 7 where one may see that the web 12 is divided into fields 118 which contain indicia. The numeral in the field may be white or translucent and the background of the field may be colored but not light transmitting. The margins 119 of the web 12 and the spaces between the fields may be opaque to serve as masks. Between each indicia field binary code marks such as those marked 1, 2, 4 and 8 are formed on the web. If the code markers are all present as they are in illustrative FIG. 7, the code would indicate an equivalent decimal number of 15. There are also longer code markers designated by the numerals 120 and 121 which provide for detecting when switching the driving motor to a lower speed should begin as the selected indicia which is being moved along with the web approaches the position in which it should be in for display. In FIG. 7, a row of combination light sources and photodetectors 122–127 are mounted in a holder 128. Using the combination detector and light source elements implies that the code markers 120, 121 and any of 1, 2, 4 or 8 are reflective. The web is transparent where the reflective markers are located and the photosensors view the markers through the web. It should be understood that the code marks can be transparent on an opaque field in which case it is practical to have the light sources on one side of the web and the photodetectors on the other side. FIGS. 3 and 4 illustrate how the photodetectors are positioned relative to the web 12. The supporting bar 128 extends over the edge of tape 12 sufficiently far, of course, to embrace the maximum number of code markers that will appear in any row between indicia fields. The photosensors are close to the web and the bar 128 that supports them is carried on an angle bracket 129 which is secured to side wall member 13 by means of screws 130.

Figure 8:
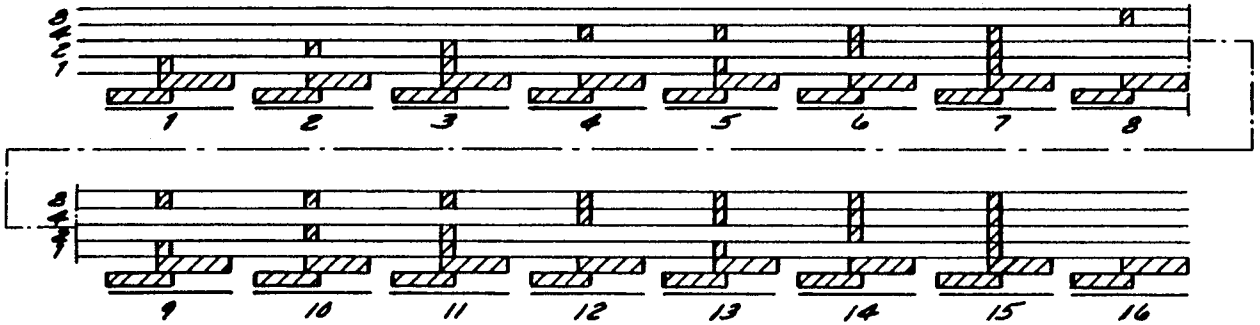
FIG. 8 depicts a sequence of 16 binary encoded data groups which are positioned, respectively, between consecutive indicia on the web as illustrated between indicia 14 an 15 in FIG. 7, for positioning a selected indicia precisely in viewing position, the dash hyphen dot line between the upper and lower sequences indicates that the data group beginning with 9 at the left end of the lower sequence follows the data group ending with 8 at the right end of the upper group.

Attention is now invited to FIG. 8 which illustrates the 16 code groups that would appear between successive fields on the web. Actually only 10 groups are needed if the indicia on the webs are only numbers. The codes for field identification are simply binary number representations. The code numbers 1–16 are sequential, each differing from a preceding number by one binary count. The dash hyphen dot line between the right end of the top row in FIG. 8 and the left end in the bottom row in that FIG. implies that they form one continuum of numbers.

It will be noted in FIG. 8 that the code marker array for each of the 16 fields on the web include the markers or bars 120 and 121 which, when they come under the photosensors, while the web is being translated to position an indicia, the electric motor is caused to revert to a slower speed until the alignment point is reached. This avoids the need for jogging and provides for automatic restoration to the point of alignment if there is over travel. For instance, if the web is being driven to the left in FIG. 7, marker bar 21 will cut across detector 126 and slow down of drive motor 57 will occur. The motor will run at slower speed until it traverses the length of bar 121. Slightly before this time, detector 127 will start passing over reflective bar 120. A signal thereby produced will cause the motor to be braked and to stop. If there is overtravel of bar 121 such that the field on the web would not be positioned exactly where it should be, the combination of signals due to a run off of bar 121 and a run onto bar 120 will cause the motor to reverse momentarily to guarantee that the field will be located with precision.

In FIG. 7, the motor will run at full speed over the distances marked C. When either of the long bars 120 or 121 start passing under either photosensors 126 or 127, depending upon the direction in which the web is being translated, the motor will revert to slow speed and run that way over the distances designated by $B_L$ and $B_R$. In any case, the motor will stop driving when the center line of the photosensors falls within the distance A.

In FIG. 8, the short bars in the channels defined by the numbers 1, 2, 4 and 8 constitute the addresses for 1–15 field positions containing indicia and a blank or blank or zero position marked 16. By way of example and not limitation, viewable areas or fields on the web in one commercial sign embodiment intended for distant viewing are about 7½ wide and about 11 inches long.

The sign modules can be arranged back-to-back in a sign housing, not shown, so the sign can be read from either side. In most installations the webs in the modules are back-lighted so the sign can be read at night. For back-lighting several fluorescent tubes such as those marked 160 and 161 in FIG. 1 are arranged in parallelism with each other and with the axes of the web rollers. The tubes are horizontal so they span across the widths of the plurality of sign modules and, since the backs of the module frames are open, light from the tubes is radiated in opposite directions towards the webs in the back-to-back modules without any part of the modules casting a shadow on the webs.

Figure 9:
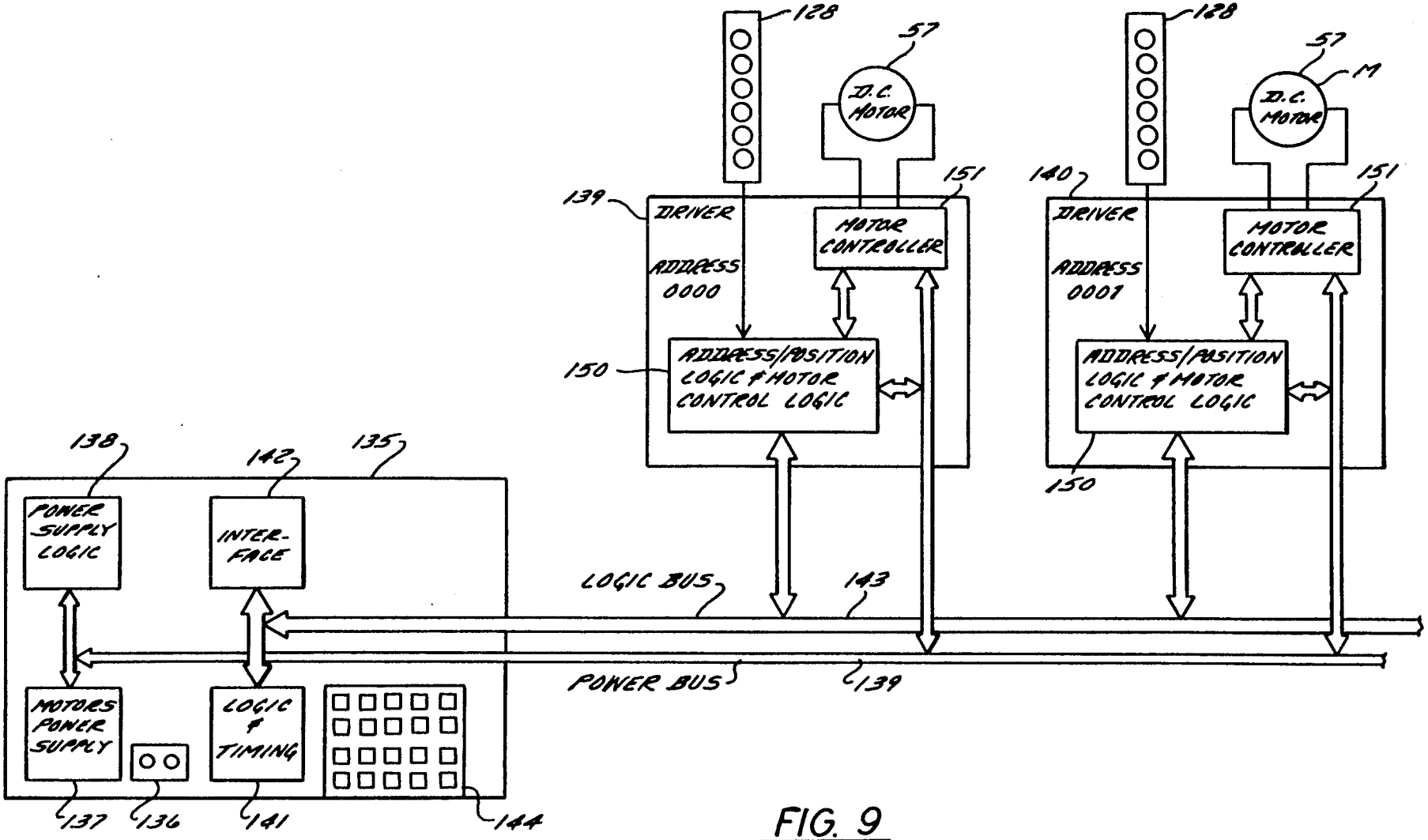
FIG. 9 is a block diagram of the electrical control system for the modules composing a sign.

A block diagram of the electrical control circuitry is shown in FIG. 9. There is a controller 135 in a console, not shown, at an operator station remote from the sign. The operator presses buttons 136 to turn the control circuitry on and off. The fluorescent tubes which illuminate the sign are connected in an electric circuit, not shown, which provides for switching the tubes on and off with manual switches or under photosensor controlled switches, not shown.

Controller 135 contains a power supply 137 for the motors 57 in the sign modules and a power supply logic board 138. These components communicate by way of a power bus 139 with drivers such as the two marked 139 and 140 which are located in the remotely located sign. Each sign contains a driver for each indicia display module. They are all controlled from a single controller 135.

Controller 135 contains a logic and timing circuit board 141 and an interface unit 142. These components are coupled to the respective drivers 139 and the like by way of a bidirectional logic bus 143. The controller also contains a keypad 144 which is provided for the operator to select the module wherein an indicia change is desired and to select the indicia which is desired to be displayed.

Typical driver 139 contains address/position decoding logic and motor controller units 150. This unit is addressed by and receives data from controller 135 for executing sign module drive commands and it returns data to the controller such as data indicating which indicia position is currently in the display window of a sign module. Unit 150 receives the signals from the photodetector array 128 which indicate that an address such as one of the binary encoded addresses in FIG. 8 has been reached. The unit 150 activates and deactivates the motor controller 151. When one of the long bars 120 or 121 of the encoded addresses shown in FIG. 8 which has been addressed from the controller comes within the view of the photodetector 126 or 127, respectively, logic unit in the related driver signals the motor controller 151 to switch the web roller drive motor 157 to slower speed following which the motor is braked to stopped an indicia field exactly where it has been commanded to stop. Position information or the present address of all indicia on the webs of all modules are fed back from the drivers to the controller at all times since the logic and timing unit of the controller must have this information to be able to determine the direction in which the drive motor 57 should run for a newly addressed indicia field to reach viewing position in the sign.

Figure 10A:
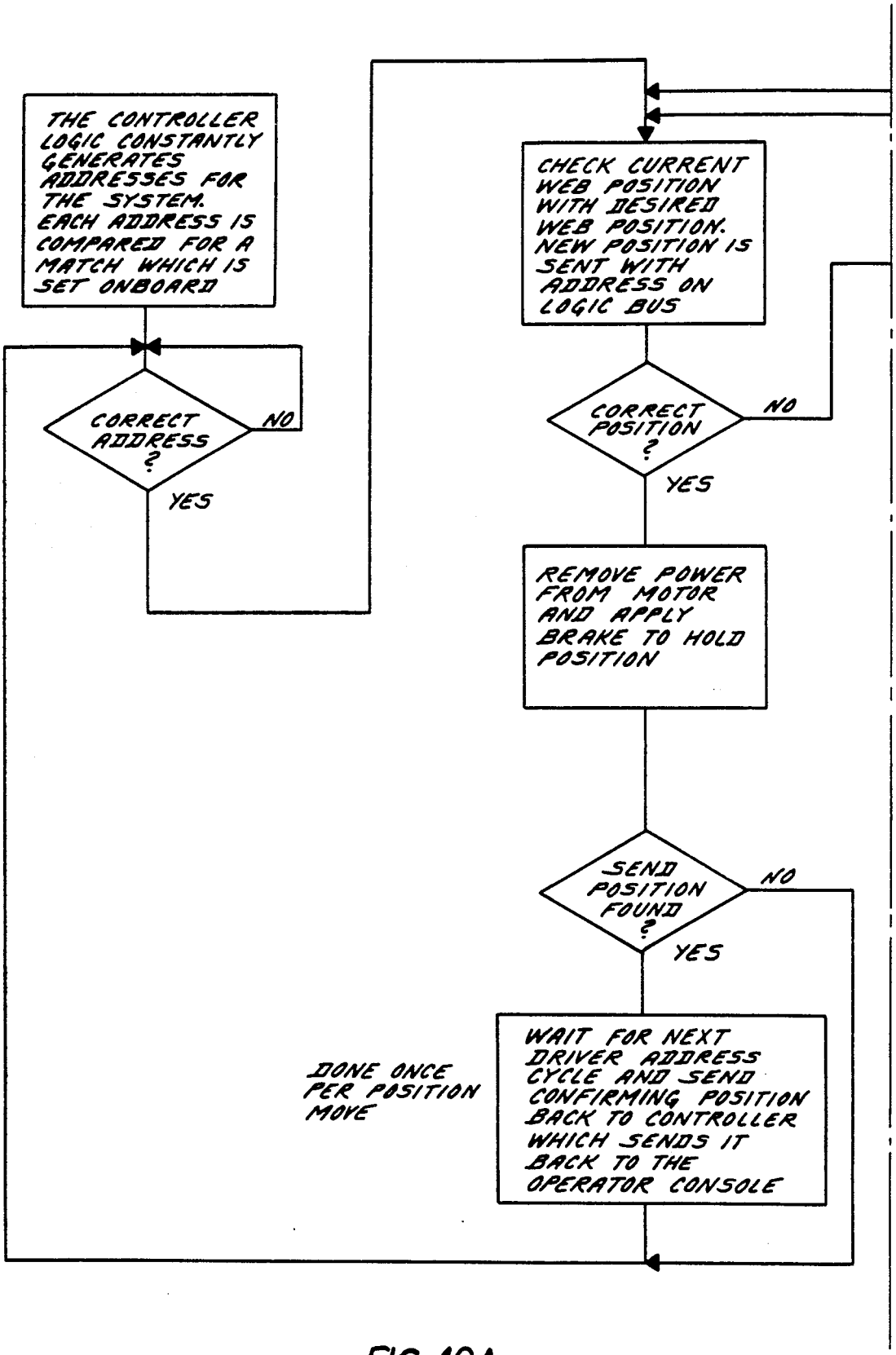
Figure 10B:
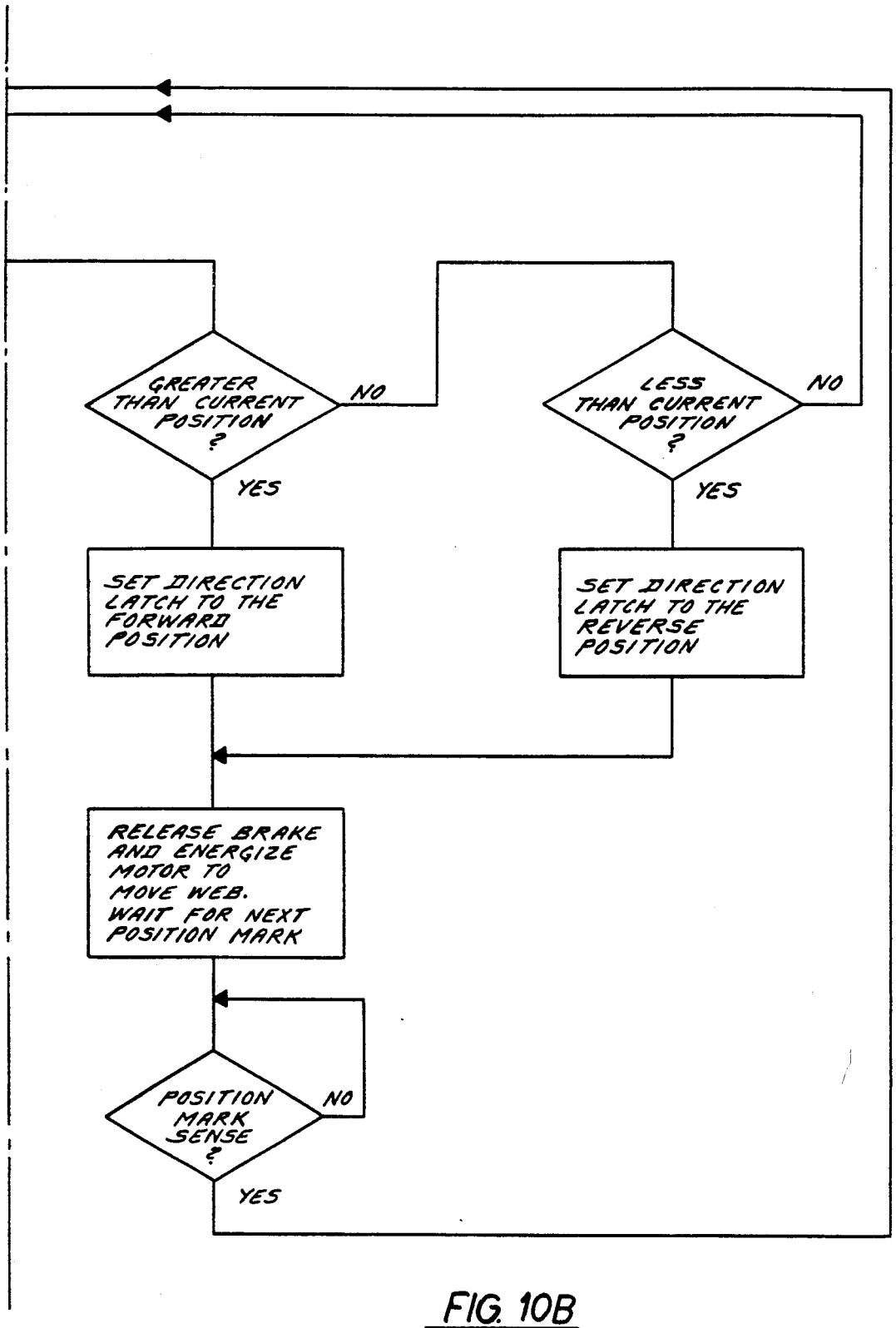

The flow diagram applicable to the control procedures just outlined is depicted in FIG. 10 and lays the basis for one skilled in the electronic art to develop the required hardware for driving the plurality of indicia bearing webs. Conventional symbols for operations and decisions are used in the diagram and the applied legends are sufficiently self-explanatory to allow forgoing further discussion of the diagram.

Although a detailed description of the invention has been given, such description is intended to be illustrative, rather than limiting, for the invention may be variously embodied and is to be limited only by interpreting the claims which follow.

We claim:

1. A scrolling sign comprising:

spaced apart support members, first and second rollers arranged between said support members in spaced apart relationship for rotating about parallel axes and a web on said rollers having opposite end portions fastened to the rollers respectively, and containing a series of indicia to be presented for viewing between rollers, means on which said rollers are journaled for rotation relative to said support members, a reversible electric motor including a motor body and a shaft mounted inside of the first of said rollers, means for connecting said body to said first roller and means for securing said shaft against rotation such that when the motor is energized said first roller is driven rotationally, rotation of said first roller in one direction allowing said web to unwind from said first roller and rotation in the opposite direction allowing said web to wind on said first one roller, a constant force spirally wound spring disposed inside of the second roller, said spring having opposite ends, a stationary member inside of said second roller to which member one end of said spring is engaged and means for connecting the other end of said spring to said second roller, controller means for controlling operation of said electric motor, operation of said electric motor to rotate said first roller in a direction for winding the web onto said first roller causing the web to unwind from said second roller and to wind said spring for resisting unwinding to maintain tension in said web and operation of said electric motor to rotate said first roller in a direction opposite of said one direction allowing said spring to wind said web onto said second roller and to hold said web in tension when operation of said motor terminates.

2. The sign according to claim 1 wherein:

said means on which said second roller is mounted for rotation includes a cylindrical hub mounted to each of said support members for extending, respectively, into opposite ends of said second roller, end caps respectively inserted in opposite ends of said second roller, said end caps being engaged with said second roller and each end cap having a central bore into which said hubs extend for journaling said second roller on said hubs, said stationary member to which said one end of the constant force spring is engaged is an elongated arbor extending axially into said second roller, said arbor having opposite ends one of which is engaged with said hub, said means for connecting the other end of said spring to said second roller comprising a cylindrical retainer member which is fastened to the second roller and has an axial bore into which the end of said arbor extends to support said spring.

3. The sign according to claim 1 wherein:

said means on which said first roller is journaled for rotation includes a cylindrical hub mounted to each of said support members for extending into opposite ends of said first roller, said means for connecting the body of said motor to said first roller comprising end caps inserted into respectively opposite ends of said first roller, said body of the electric motor being mounted to one of said end caps at one end of the first roller and said one end cap being fastened to said first roller, said one end cap having a bore journaled for rotation on one of said hubs, the end cap at the opposite end of the first roller also having a bore journaled on the other hub at said opposite end of the first roller.

4. The sign according to claim 3 including:

an insulating member and means for mounting said member to one of said end caps of the first roller for rotating with said motor body, said end cap and said first roller about one of said hubs, annular conductive elements mounted to said insulating member in radially spaced apart relationship, another insulating member and means for mounting said other insulating member to the other of said hubs for said first roller, a pair of electric contact means mounted on the other insulating member for making electrical contact with said annular conductive elements, respectively, and conductors for electrically connecting said annular conductive elements, respectively, to said motor.

5. The sign according to claim 1 wherein:

said spaced apart support members are side wall members which are spaced apart by a distance slightly greater than the width of the rollers for the rollers to fit closely between said members, cross-tie members spanning between said side wall members and having opposite ends fastened to said wall members, respectively, to form a module for handling one of said indicia containing webs, bracket members mounted to said side wall members, said bracket members having a part disposed in parallelism with said portion of the web extending between said rollers and having module mounting holes, frame members comprising said sign having holes corresponding to said module mounting holes, bolt means extending through said module mounting holes and corresponding frame member holes and nuts turned on said bolt means sufficiently to allow said bracket members and frame members to be spaced from each other, and compression springs interposed between said frame members and bracket members in stressed condition resulting from said nuts being tightened on said bolt means.

6. A sign according to claim 5 comprised of a plurality of said modules mounted side-by-side on said frame members.

7. The sign according to claim 1 including:

a sequence of encoded numbers representing indicia addresses on said web, each address constituted by a row of binary digit markers, one encoded number being associated with each indicia on the web to provide for determining when an indicia which is associated with a particular number is positioned in viewing position between said rollers, said controller means including means for an operator to address an indicia which is to be moved into viewing position, stationary photosensor means for sensing the encoded numbers on said web successively as said web is being wound on one of the rollers and unwound from the other of the rollers while said electric motor in the first roller is energized, said controller means responding to the addressed encoded number on the web associated with the desired indicia being sensed by stopping said electric motor so that said web stops with said indicia addressed by the operator disposed in viewing position.

8. The sign according to claim 7 including long markers in said row of binary digit markers which extend a greater distance in the lengthwise direction of the web than the other code markers in said row, said controller means responding to initial sensing of said long markers when said web is moving by causing said electric motor to reduce its speed and come to a stop when said addressed indicia is in viewing position.

* * * * *